US008956186B2

(12) United States Patent
de Chazal

(10) Patent No.: US 8,956,186 B2
(45) Date of Patent: Feb. 17, 2015

(54) RIGHT ANGLE HEADER ASSEMBLY

(71) Applicant: Tyco Electronics Corporation, Berwyn, PA (US)

(72) Inventor: Aaron James de Chazal, Rochester, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 28 days.

(21) Appl. No.: 13/799,433

(22) Filed: Mar. 13, 2013

(65) Prior Publication Data

US 2014/0273628 A1 Sep. 18, 2014

(51) Int. Cl.

| | |
|---|---|
| ***H01R 13/658*** | (2011.01) |
| ***H01R 13/652*** | (2006.01) |
| ***H01R 24/00*** | (2011.01) |
| ***H01R 13/502*** | (2006.01) |
| ***H01R 13/53*** | (2006.01) |
| ***H01R 13/6581*** | (2011.01) |

(52) U.S. Cl.

CPC ..... *H01R 13/652* (2013.01); *H01R 23/10* (2013.01); *H01R 13/502* (2013.01); *H01R 13/53* (2013.01); *H01R 13/6581* (2013.01); *H01R 2201/26* (2013.01)

USPC ..... 439/607.27

(58) Field of Classification Search

USPC ..... 439/607.27, 607.23, 607.24, 607.32, 439/152

See application file for complete search history.

(56) References Cited

U.S. PATENT DOCUMENTS

| | | | | |
|---|---|---|---|---|
| 4,333,702 | A | 6/1982 | Herrmann, Jr. | |
| 6,793,531 | B1 * | 9/2004 | Zhang | 439/607.04 |
| 7,037,135 | B2 * | 5/2006 | Chen et al. | 439/607.08 |
| 7,101,203 | B2 * | 9/2006 | Saethre et al. | 439/152 |
| 7,168,985 | B1 * | 1/2007 | Zhang et al. | 439/607.23 |
| 7,654,871 | B2 * | 2/2010 | Yi et al. | 439/660 |
| 7,753,732 | B2 * | 7/2010 | Kameyama et al. | 439/607.27 |
| 7,771,235 | B2 * | 8/2010 | Kameyama | 439/607.27 |
| 8,251,748 | B2 * | 8/2012 | Tyler et al. | 439/607.52 |
| 8,597,043 | B2 * | 12/2013 | Zhao | 439/350 |
| 2009/0318025 | A1 * | 12/2009 | Kameyama | 439/607.09 |
| 2009/0318026 | A1 * | 12/2009 | Yi et al. | 439/607.24 |
| 2010/0003852 | A1 * | 1/2010 | Myer et al. | 439/607.17 |
| 2011/0151715 | A1 * | 6/2011 | Engbring et al. | 439/587 |

(Continued)

FOREIGN PATENT DOCUMENTS

EP 2 418 742 A1 2/2012

OTHER PUBLICATIONS

International Search Report, International Application No. PCT/US2014/020623, International Filing Date, Mar. 5, 2014.

*Primary Examiner* — Alexander Gilman

(57) ABSTRACT

A high voltage (HV) header assembly includes an outer housing having a right angle body including a first segment and a second segment oriented perpendicularly to the first segment. The first segment has a mating interface at a distal end for mating with a plug assembly. The second segment has a mounting flange at a distal end for mounting to a device. The second segment extends from the first segment such that the mounting flange is oriented perpendicularly to the mating interface. The body defines a right angle chamber extending through the first and second segments between the mating interface and the mounting flange. The chamber has first and second openings therethrough in the first and second segments, respectively. HV contacts are received in the chamber of the outer housing and are configured to electrically connect to plug contacts of the plug assembly.

20 Claims, 6 Drawing Sheets

(56) References Cited

U.S. PATENT DOCUMENTS

2012/0184139 A1* 7/2012 Long ..... 439/607.31
2012/0238124 A1* 9/2012 Zhao ..... 439/350
2013/0059472 A1* 3/2013 Saito ..... 439/607.27
2013/0196525 A1* 8/2013 Takamatsu ..... 439/232
2013/0252465 A1* 9/2013 Dang ..... 439/607.05
2014/0106588 A1* 4/2014 Suzuki et al. ..... 439/271
2014/0120763 A1* 5/2014 Itsuki et al. ..... 439/382

* cited by examiner

RIGHT ANGLE HEADER ASSEMBLY

BACKGROUND OF THE INVENTION

The subject matter herein relates generally to right angle header assemblies.

Increased fuel costs and increased efforts at reducing environmental pollution have lead the automotive industry towards electric and hybrid electric vehicles (HEV). The electrical systems of these vehicles include components that operate at high voltages and require high voltage pathways including connectors. For example, some known vehicular electrical systems include components that operate using up to and beyond 600 volts.

In some current automotive applications, high voltage shielded connector assemblies are used to provide a stable, sealed mechanism and electrical connection between a high voltage plug assembly and a header assembly mounted to an electronic device in a vehicle, such as a heating or air conditioning unit. The assemblies may need to provide robust shielding continuity between the assemblies and/or other components in the device. Due to space requirements or design preferences, the assemblies may need to provide such robust shielding continuity along a 90° bend.

Known 90° connector assemblies for high voltage automotive applications are not without disadvantages. For example, the 90° bend is accomplished in the plug assembly. There is a large amount of room required to mate the plug assembly to the device because the plug is mated in a direction perpendicular to the panel of the device. Such connector assemblies face certain design challenges. For example, problems exist with routing a high voltage circuit and a high voltage interlock circuit through the 90° bend, and routing a shield circuit through the same 90° bend. Another problem is accomplishing the 90° bend in a small package that can be mass produced.

A need remains for a right angle panel-mount header assembly designed for high voltage application.

BRIEF DESCRIPTION OF THE INVENTION

In one embodiment, a high voltage (HV) header assembly includes an outer housing and HV contacts. The outer housing has a right angle body including a first segment and a second segment oriented perpendicularly to the first segment. The first segment has a mating interface at a distal end thereof defining a socket for mating with a plug assembly. The second segment has a mounting flange at a distal end thereof configured to be mounted to a device. The second segment extends from the first segment such that the mounting flange is oriented perpendicularly to the mating interface. The body defines a right angle chamber extending through the first and second segments between the mating interface and the mounting flange. The chamber has first and second openings therethrough in the first and second segments, respectively. The first and second openings are perpendicular to one another. The HV contacts are received in the chamber of the outer housing. The HV contacts are configured to electrically connect to plug contacts of the plug assembly. The HV contacts each have a stem extending at least partially along the first segment. The HV contacts each have a tail extending at least partially along the second segment.

Optionally, the HV header assembly may further include a first shield received within the chamber through the first opening. A first inner housing may be received within the chamber with the first shield surrounding at least a portion of the first inner housing. The first inner housing may define channels to house the HV contacts. Optionally, the HV header assembly may further include a second shield received within the chamber through the second opening. The second shield may be electrically connected to the first shield. The second shield may be oriented perpendicularly to the first shield within the chamber. Optionally, the HV header assembly may further include a second inner housing received within the chamber. The second shield may surround at least a portion of the second inner housing. The second inner housing may define cavities to house HV terminals. The HV terminals may be electrically connected with the HV contacts. Optionally, the HV header assembly may further include high voltage interlock (HVIL) contacts received in the chamber of the outer housing. The HVIL contacts are configured to electrically connect to HVIL plug contacts of the plug assembly.

In another embodiment, a HV header assembly includes an outer housing, a contact subassembly, and a terminal subassembly. The outer housing has a right angle body comprising a first segment and a second segment oriented perpendicularly to the first segment. The body defines a right angle chamber extending through the first and second segments. The chamber has first and second openings therethrough in the first and second segments, respectively. The contact subassembly is received in the chamber through the first opening. The contact subassembly includes a first shield, a first inner housing at least partially surrounded by the first shield, HV contacts received within a first set of channels within the first inner housing, and HVIL contacts received within a second set of channels within the first inner housing. The terminal subassembly is received in the chamber through the second opening. The terminal subassembly includes a second shield, a second inner housing at least partially surrounded by the second shield, HV terminals received within a first set of cavities within the second inner housing, and HVIL terminals received within a second set of cavities within the second inner housing. The contact subassembly is coupled to the terminal subassembly at a separable interface within the chamber. The contact subassembly is oriented perpendicularly to the terminal subassembly.

DETAILED DESCRIPTION OF THE INVENTION

Figure 1:
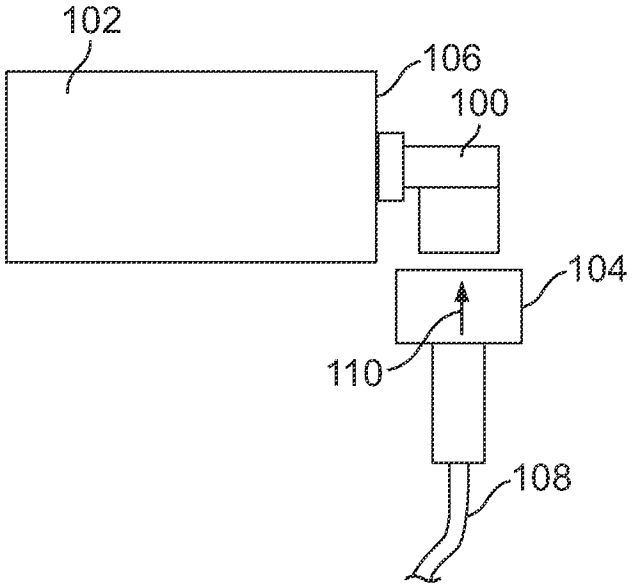
FIG. 1 illustrates an HV header assembly formed in accordance with an exemplary embodiment.

FIG. 1 illustrates an HV header assembly 100 coupled to a device 102. A plug assembly 104 is configured to be mated with the HV header assembly 100. The HV header assembly 100 is mounted to a panel 106 of the device 102, such as along a side of the device 102. The device 102 may be a component used in an automotive application, such as a battery, an A/C unit, and the like. Alternatively, the HV header 100 may be used in other types of applications other than automotive applications. The HV header and plug assemblies 100, 104 may be power connectors for delivering power to and/or from the device 102. Optionally, the HV header and plug assemblies 100, 104 may be high voltage connectors, such as those typical of electric or hybrid electric vehicles. The HV header and plug assemblies 100, 104 may be used at high voltage levels, such as above 600 volts. Optionally, the high voltage levels may be approximately 600 volts. The HV header and plug assemblies 100, 104 may be used to transfer data in addition to, or alternatively to, power.

The plug assembly 104 may house HV electrical conductors (not shown). The electrical conductors may include wires that extend from the plug assembly 104 through a cable 108. The cable 108 may electrically connect the plug assembly 104 to a printed circuit board and/or terminals of another device, such as a battery, a motor, and the like. Optionally, the plug assembly 104 may connect directly to the other device, without the use of a cable. When the plug assembly 104 is mated with the HV header assembly 100, the electrical components (not shown) within the device 102 are electrically connected to the other device and may communicate with and/or transfer power to/from the device 102.

In an exemplary embodiment, the HV header assembly 100 has a right angle shape. As used herein, "right angle" generally refers to two planes that are generally perpendicular and/or have a relative angle of approximately 90°, though the angle does not have to be exact. Upon moving the plug assembly 104 towards the HV header assembly 100 for mating, the plug assembly 104 is moved in a plugging direction 110. The plugging direction 110 is generally parallel to the plane defined by the panel 106. The right angle shape of the HV header assembly 100 may be useful in applications with limited clearance between the panel 106 and an obstruction (not shown) near the non-panel side of the HV header assembly. For example, other devices or other components may be mounted adjacent the device 102 that leave relatively tight clearances along the sides of the device 102. However, the plug 104 may be successfully mated along the plugging direction 110 and unmated in the opposite direction in such tight spaces because the plugging direction 110 is parallel to the panel 106.

The HV header assembly 100 may be sized to extend outward from the panel 106 no farther than a traditional straight or 180° panel-mount header extends. Therefore, the area occupied, or "footprint", of the mounted HV header assembly 100 may be the same or less than traditional straight header connectors. Furthermore, because the HV header assembly 100 includes a right angle bend, the plug assembly 104 need not be specially designed for right angle connections. For example, the HV header assembly 100 may be configured to mate with the same plug assembly that mates with straight or 180° header connectors.

Figure 2:
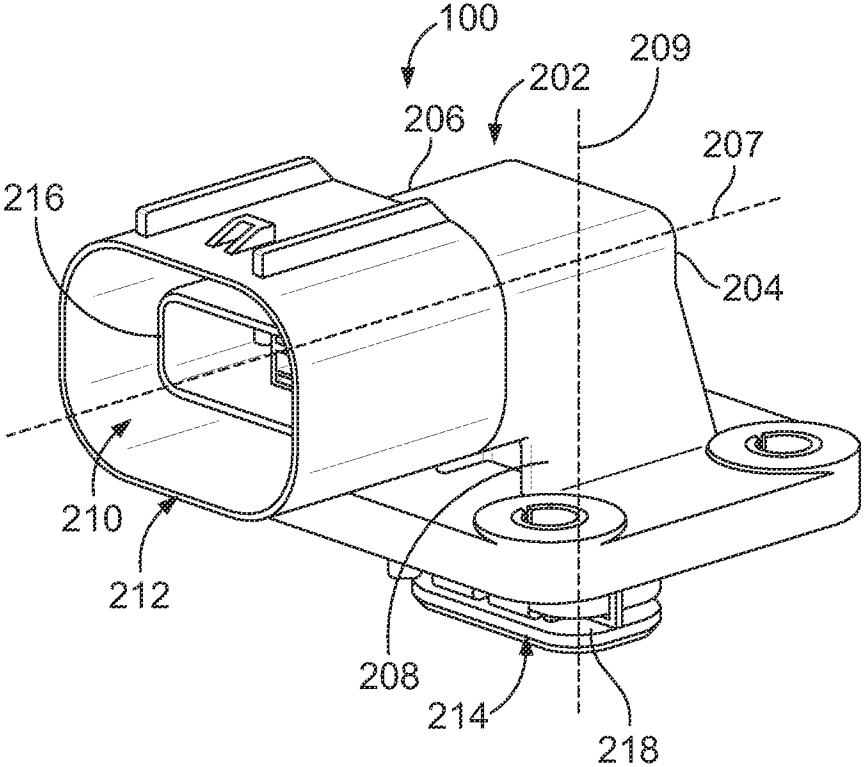
FIG. 2 is a perspective view of the HV header assembly.

FIG. 2 is a perspective view of the HV header assembly 100. The HV header assembly 100 includes an outer housing 202 that has a right angle body 204. The body 204 includes a first segment 206 and a second segment 208 that is oriented perpendicularly to the first segment. The first segment 206 extends along a first axis 207. The second segment 208 extends along a second axis 209 which intersects the first axis 207 at a right angle. The body 204 defines a right angle chamber 210 that extends through the first and second segments 206, 208. The chamber 210 through the first segment 206 extends along the first axis 207, and the chamber 210 through the second segment 208 extends along the second axis 209. The first segment 206 includes a first opening 212 to the chamber 210. The second segment 208 includes a second opening 214 to the chamber 210. A cross-sectional plane of the first opening 212 may be generally perpendicular to a cross-sectional plane of the second opening 214.

The HV header assembly 100 includes a contact subassembly 216 and a terminal subassembly 218. The contact subassembly 216 is configured to be received in the chamber 210 through the first opening 212. The terminal subassembly 218 is configured to be received in the chamber 210 through the second opening 214. The contact subassembly 216 may be oriented generally perpendicularly to the terminal subassembly within the chamber 210.

Optionally, the first segment 206 may be oriented at an angle more or less than 90° relative to the second segment 208, while the body 204 still defines a right angle chamber 210 that receives the contact subassembly 216 and the terminal subassembly 218 in perpendicular relation to each other. The contact subassembly 216 need not be parallel to the first segment 206 of the outer housing 202, and the terminal subassembly 218 need not be parallel to the second segment 208. In other embodiments, the HV header assembly 100 may be configured to dispose the contact subassembly 216 at an angle more or less than 90° relative to the terminal subassembly 218.

Figure 3:
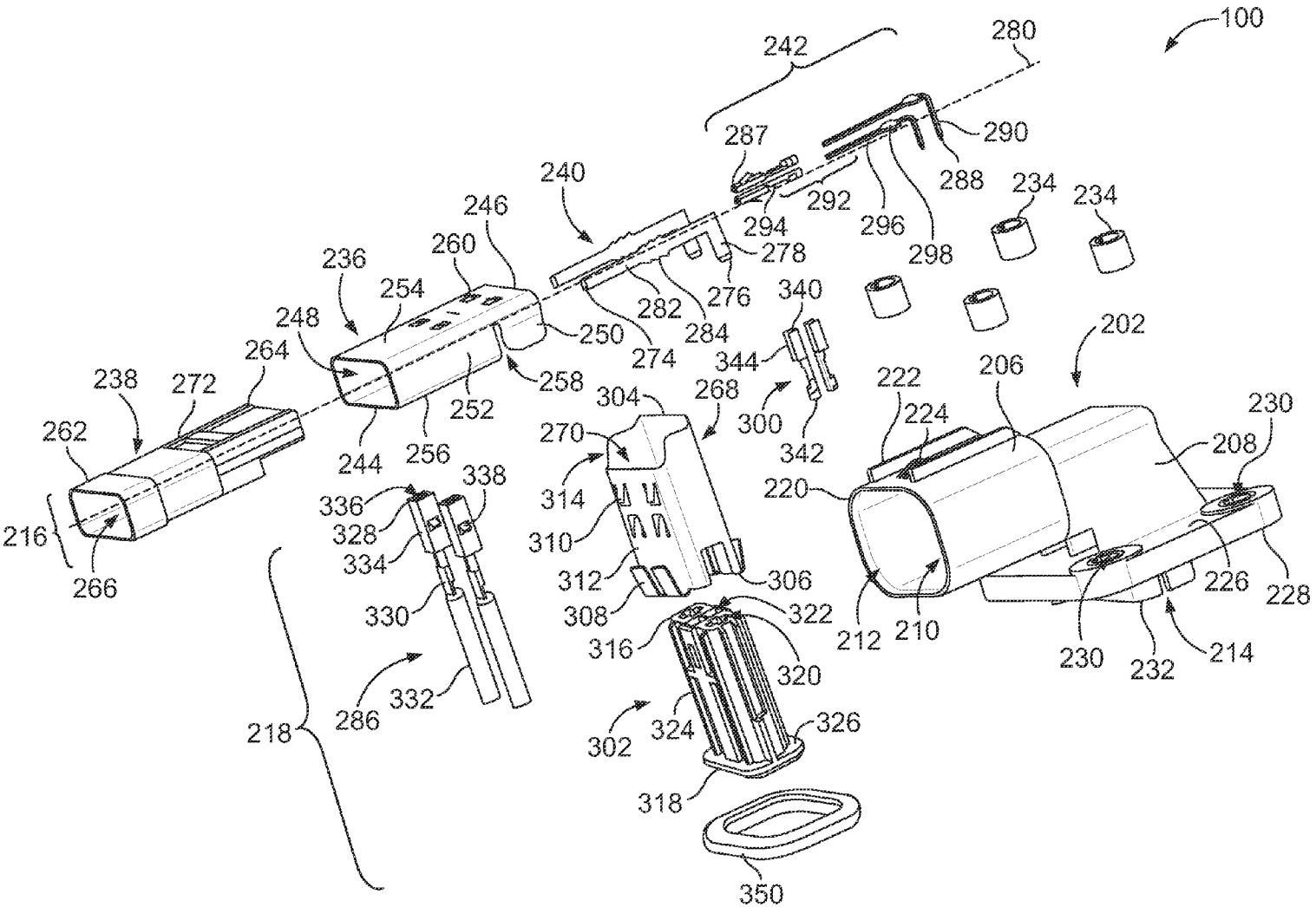
FIG. 3 is an exploded view the HV header assembly.

FIG. 3 is an exploded view of the HV header assembly 100. The outer housing 202 includes a mating interface 220 at a distal end of the first segment 206. The mating interface 220 may define a socket for mating with the plug assembly 104 (shown in FIG. 1). The first opening 212 to the chamber 210 may define the mating interface 220. The mating interface 220 may be circular, elliptical, rectangular, triangular, or another shape. Optionally, the first segment 206 along or proximate to the mating interface 220 may include one or more raised or recessed rails 222 for guiding the plug assembly during mating and unmating. The first segment 206 may include one or more protrusions 224 or recessions that interfere with a housing of the plug assembly to prohibit unintentional unmating of the plug from the HV header assembly 100. The rails 222 and/or protrusions 224 may be located within the defined socket and/or exterior to the socket.

The outer housing 202 includes a mounting flange 226 at a distal end of the second segment 208. The mounting flange 226 is configured to mount to the panel 106 of the device 102 (shown in FIG. 1). The mounting flange 226 may have a rectangular or elliptical shape with a flat bottom face 228. In an exemplary embodiment, the mounting flange 226 is oriented perpendicularly to the mating interface 220. The mounting flange 226 may define the second opening 214 to the chamber 210. As such, the chamber 210 extends through the body 204 of the outer housing 202 between the mounting flange 226 and the mating interface 220. The mounting flange 226 includes a plurality of bores 230 formed therethrough.

To mount the HV header assembly 100 to the panel 106 of the device 102 (both shown in FIG. 1), the outer housing 202 is positioned against the panel 106 such that the bottom face 228 lies flush against the surface of the panel 106. The HV header assembly 100 is fixed to the panel 106 by installing a mechanical fastener (e.g., nail, screw, bolt, rivet, etc.) through one or more of the bores 230. Optionally, prior to installing the fasteners, the bores 230 may be inlaid with compression limiters 234, or other non-threaded bushings, designed to protect the outer housing 202 from compressive loads generated by the tightening of the fasteners to the panel. Alternatively, or in addition, the HV header assembly 100 may be chemically bonded to the panel 106 using glue or welding. The outer housing 202 may optionally include a boss 232 that extends from the bottom face 228 of the mounting flange 226. Upon mounting the HV header assembly 100 to the panel 106, the boss 232 may be configured to extend at least partially into an orifice in the panel 106, which serves to properly align and support the header assembly 100.

In an exemplary embodiment, the outer housing 202 is formed as a single piece. For example, the outer housing 202 may be composed of plastic and manufactured in a mold. The first and second segments 206, 208 are integral and part of the one-piece body. The first and second segments 206, 208 are co-molded. Alternatively, the outer housing 202 may be composed of other materials, such as metal or ceramic, and may be formed by processes other than molding.

In an exemplary embodiment, the contact subassembly 216 includes a first shield 236, a first inner housing 238, HV contacts 240, and HVIL contacts 242. The terminal subassembly 218 includes a second shield 268, a second inner housing 302, HV terminals 286, and HVIL terminals 300. In alternative embodiments, the contact subassembly and terminal subassembly may include different components than the contact subassembly 216 and terminal subassembly 218, such as, for example, replacing the HVIL contacts and HVIL terminals with a different power circuit.

The shield 236 of the contact subassembly 216 extends between a front 244 and a rear 246. The shield 236 has a shield cavity 248 extending between the front 244 and the rear 246. The inner housing 238 is configured to be received in the shield cavity 248 such that at least a portion of the inner housing 238 is surrounded by the shield 236. In an exemplary embodiment, the shield 236 is manufactured from a conductive material such as metal. The shield 236 may be stamped and formed into a desired shape. The shield 236 provides electrical shielding around a portion of the inner housing 238 and provides electrical shielding around the HV contacts 240 and HVIL contacts 242. The shield 236 may provide shielding from electromagnetic interference (EMI), or other types of interference.

The shield 236 may include one or more deflectable beams 250 at the rear 246. The deflectable beams 250 may be partially cut-out and/or bent sections of the shield 236. In an exemplary embodiment, deflectable beams 250 are located along both sides 252 of the shield 236. Upon mating the contact subassembly 216 to the terminal subassembly 218 within the chamber 210, the deflectable beams 250 may be biased against the second shield 268 of the terminal subassembly 218 to ensure contact with the shield 268. Alternatively, the shield 236 may include more than two deflectable beams 250 located on the sides 252 and/or extending downward from a top 254 and/or bottom 256 of the shield 236. Alternatively, deflectable beams 250 are disposed on shield 268 of the terminal subassembly 218 instead of shield 236.

The shield 236 includes one or more tabs 260 located generally proximate to the rear 246. The tabs 260 may be formed by stamping and bending the tabs 260 out of the surface of the shield 236. In an exemplary embodiment, the tabs 260 are disposed along the top 254 of the shield 236. Alternative embodiments include different configurations of tabs 260. The tabs 260 are used to secure the shield 236 within the outer housing 202. The tabs 260 may interfere with predefined extensions or grooves within the interior surface of the outer housing 202 that defines the chamber 210. Additionally, the interference between the tabs 260 and the extensions or grooves within the outer housing 202 may provide a stop point when the contact subassembly 216 is loaded into the chamber 210. Alternatively, the header subassembly 100 may be designed such that the loading stop point for the contact subassembly 216 is the point at which the rear 246 of the shield 236 contacts an inner surface of the second segment 208 of the outer housing 202.

In an exemplary embodiment, the shield 236 defines an exposed region 258 along the bottom 256 of the shield 236 proximate to the rear 246. The exposed region 258 may be a cut-out or recessed portion of the bottom 256 of the shield 236 that is configured to allow the contact subassembly 216 to couple to the terminal subassembly 218 at a right angle within the chamber 210. When mated, the exposed region 258 provides an opening that exposes the first shield cavity 248 to a cavity 270 within the second shield 268 of the terminal subassembly 218, resulting in a combined right angle shield cavity.

The first inner housing 238 includes a front 262 and a rear 264. The inner housing 238 has an inner cavity 266 at the front 262. The inner cavity 266 leads to one or more contact channels 404, 406 (shown in FIGS. 4 and 5, respectively) that receive the HV contacts 240 and HVIL contacts 242. The channels extend from the rear 264 and open into the inner cavity 266. In an exemplary embodiment, the inner housing 238 defines a first set of channels configured to house the HV contacts 240 and a second set of channels configured to house the HVIL contacts 242. The inner housing 238 may be a dielectric material, such as plastic, ceramic, rubber, glass, and the like. The inner housing 238 provides insulation between the contacts 240, 242, to prohibit the flow of current between adjacent contacts 240, 242. In an exemplary embodiment, the inner housing 238 includes one or more locking surfaces 272 used to secure the inner housing 238 within the shield 236. For example, the locking surface 272 may be a depression in the inner housing 238 that is configured to engage the downward-extending tabs 260 of the shield 236. Alternatively, the locking surface 272 may be a protrusion configured to extend into a bump or opening in the shield 236, such as an opening formed by an upward-extending tab 260.

The HV contacts 240 and HVIL contacts 242 are configured to electrically connect to respective plug contacts of the plug assembly 104 (shown in FIG. 1) to transfer high voltage power and/or data between one or more electrical components in the device 102 (shown in FIG. 1) and a device connected to the plug assembly 104 (shown in FIG. 1). The HVIL contacts 242 are configured to complete an HVIL circuit that may control the operation of the high voltage circuit of the device 102. For example, HV current/voltage is unable to flow until after the HVIL circuit is made. Additionally, during unmating of the plug assembly 104, the HVIL contacts 242 unmate first, which shuts off the HV circuit prior to the HV contacts 240 unmating. Arcing and contact damage is reduced by use of the HVIL circuit. In an alternative embodiment, the HVIL contacts 242 are replaced by one or more non-HVIL contacts.

The HV contacts 240 have a mating end 274 and a terminating end 276. The mating end 274 is configured to electrically connect to corresponding HV plug contacts. The terminating end 276 is configured to electrically connect to HV terminals 286 of the terminal subassembly 218. In an exemplary embodiment, the terminating end 276 is oriented perpendicularly to the mating end 274. For example, the terminating end 276 may have a tail 278 extending perpendicularly to a longitudinal axis 280 of the contact subassembly 216. The mating end 274 has a stem 282 that extends parallel to the longitudinal axis 280 and perpendicular to the tail 278. The stem 282 may include one or more retention features 284, for example raised serrated ridges, designed to provide additional interference within the respective channel (not shown) of the inner housing 238 to prohibit unintentional movement within the channel.

The HV contacts 240 may be manufactured from a conductive material such as metal. The HV contacts may be stamped and formed into a desired shape. In an exemplary embodiment, the HV contacts 240 are planar. In an exemplary embodiment, the stem 282 is longer than the tail 278. The tail 278 may be a blade or a pin. Alternatively, the tail may be formed as a socket. In an alternative embodiment, the HV contacts are linear and/or do not have a tail at a terminating end.

The HVIL contacts 242 have a mating end 287 and a terminating end 288 oriented perpendicularly to the mating end 287. The mating end 287 is configured to electrically connect to corresponding HVIL plug contacts, and the terminating end 276 is configured to electrically connect to HVIL terminals 300 of the terminal subassembly 218. Like the HV contacts 240, the terminating end 276 of the HVIL contacts 242 may include a tail 290 that extends perpendicularly to the longitudinal axis 280. The mating end 287 has a stem 292 that extends parallel to the longitudinal axis 280 and perpendicular to the tail 278. Optionally, the stem 292 may include a first segment 294 and a second segment 296 joined together through sonic welding, crimping, and the like. Each HVIL contact 242 may include one or more retention features 298 that extend from a plane of the HVIL contacts 242 for providing additional interference within the respective channel (not shown) of the inner housing 238. The HVIL contacts 242 may be stamped and formed from a conductive material such as metal. In an exemplary embodiment, the tail 290 is shorter than the stem 292 and shaped as a pin or a blade configured to be received within a socket of the HVIL terminal 300. Alternatively, the tail may not be perpendicular to the axis 280 and/or has a socket configured to receive a pin or blade of an HVIL terminal.

The second shield 268 of the terminal subassembly 218 extends between a top 304 and a bottom 306, and has the second shield cavity 270 extending between the top 304 and the bottom 306. The inner housing 302 is received in the shield cavity 270 such that at least a portion of the inner housing 302 is surrounded by the shield 268. In an exemplary embodiment, the shield 268 is manufactured from a conductive material such as metal. The shield 268 may be stamped and formed into a desired shape. The shield 268 provides electrical shielding around a portion of the inner housing 302 from EMI or other types of interference. The shield 268 provides electrical shielding around the HV terminals 286 and HVIL terminals 300.

The shield 268 includes one or more ground fingers 308 extending from the bottom 306. The ground fingers 308 are configured to engage the panel 106 of the device 102 (both shown in FIG. 1) to electrically common the shield 268 to the panel 106, which may be electrically grounded. The ground fingers 308 constitute spring fingers that are deflectable and may be biased against the panel 106 to ensure contact with the panel 106. In an exemplary embodiment, the ground fingers 308 extend generally in the direction towards the top 304 of the shield 268. The ground fingers 308 may be configured to engage the mounting flange 226 of the outer housing 202 to ensure proper alignment of the shield 268 within the chamber 210. In an exemplary embodiment, the ground fingers 308 may be configured to extend partially around the boss 232 of the mounting flange 226 to contact the panel 106 along the orifice (not shown).

Figure 9:
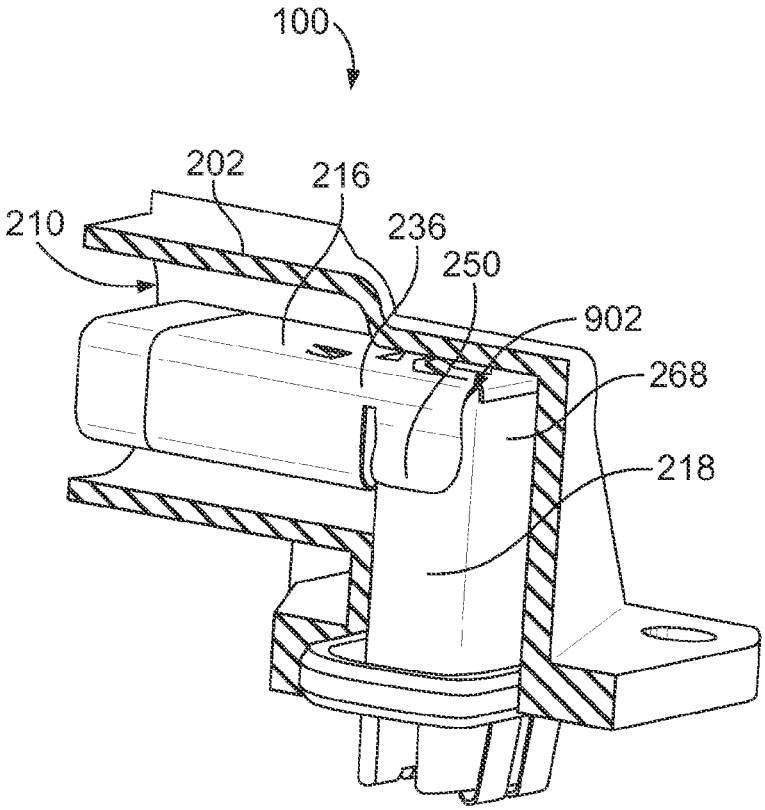
FIG. 9 is a partial sectional view of the HV header assembly showing a section of the outer housing.

The shield 268 may include one or more tabs 310 to secure the shield 268 within the outer housing 202, and to secure the second inner housing 302 to the shield 268. The tabs 310 may be formed by stamping and bending. In an exemplary embodiment, the tabs 310 are disposed along a front side 312 of the shield 268. Alternative embodiments include different tab 310 configurations. In an exemplary embodiment, the shield 268 defines an exposed region 314 along the front side 312 of the shield 268 proximate to the top 304. The exposed region 314 is configured to interface with the exposed region 258 of the first shield 236 when the terminal subassembly 218 is coupled to the contact subassembly 216 at a right angle within the chamber 210. The exposed regions 258, 314 interface at the opening between the first shield cavity 248 and the second shield cavity 270 to define a continuous, right angle shield cavity. The shields 236, 268 are configured to provide full 360° shielding of the electrical components throughout the length of the chamber 210 including the right angle (as shown in FIG. 9).

The second inner housing 302 includes a top 316 and a bottom 318. The inner housing 302 may define a first set of cavities 320 configured to receive the HV terminals 286 and a second set of cavities 322 configured to receive the HVIL terminals 300. The cavities 320, 322 may extend from the bottom 318 to the top 316 of the inner housing 302. The inner housing 302 may be a dielectric material, such as plastic, ceramic, rubber, glass, and the like, to electrically insulate the individual terminals 286, 300. In an exemplary embodiment, the inner housing 302 includes one or more locking surfaces 324, such as a depression, configured to engage one or more inward-extending tabs 310 to secure the inner housing 302 within the shield 268. Alternatively, the locking surface may be a protrusion configured to extend into a bump or opening in the shield 268. In an exemplary embodiment, the inner housing 302 includes a flange 326 proximate to the bottom 318. The flange 326 acts as a stop for loading the inner housing 302 into the shield 268 and/or into the outer housing 202.

The HV terminals 286 and HVIL terminals 300 are configured to electrically connect to respective HV and HVIL contacts 240, 242 to transfer high voltage power and/or data through the right angle turn in the HV header assembly 100. The HV terminals 286 may be generally linear with a contact end 328 and a cable end 330. The contact end 328 is configured to electrically connect to the terminating end 276 of the HV contact 240. The cable end 330 is configured to mount to one or more insulated electrical cables 332 leading to electrical components (not shown) within the device 102 (shown in FIG. 1). For example, the cable end 330 of the HV terminals 286 may be crimped or soldered to the cables 332. In an exemplary embodiment, the HV terminals 286 may be receptacles configured to receive the HV contacts 240 to electrically connect the HV contacts 240 to the HV terminals within the chamber 210. For example, the HV terminals 286 may include a socket 334 along the contact end 328 that is configured to receive the tail 278 of the HV contacts 240 within a slot 336 at the contact end 328. Alternatively, the HV terminal may have a tail that is received within a socket of the HV contact. In an alternative embodiment, the HV terminal may be a right angle terminal configured to electrically connect to a linear HV contact.

The HV terminals 286 may be manufactured from a conductive material such as metal. The HV terminals 286 may be stamped and formed into a desired shape. The HV terminals 286 may include one or more retention features 338 to provide additional interference within the cavities 320 of the inner housing 302 to prohibit unintentional movement within the cavities 320.

The HVIL terminals 300 have a contact end 340 and a mounting end 342. The HVIL terminals 300 may be generally linear with the contact end 340 configured to electrically connect to the HVIL contacts 242 and the mounting end 342 cable-mounted to an electrical component (not shown) of the device 102 (shown in FIG. 1). For example, the HVIL terminals 300 may be receptacles and have a socket 344 along the contact end 340 that is configured to receive the tail 290 of the HVIL contacts 242 through a slot (not shown). In alternative embodiments, the HVIL terminals may have a right angle bend and/or a tail configured to be received in a socket of the HVIL contacts. The mounting end 342 may be soldered or crimped to a cable (not shown) that extends into the device 102 and leads to the electrical component. The HVIL terminals 300 may be stamped and formed out of a conductive material such as metal. The HVIL terminals 300 optionally include retention features (not shown) to provide additional interference within the cavities 322 of the inner housing 302.

Optionally, the HV header assembly 100 may include a seal 350. The seal 350 may be a round loop, such as an O-ring gasket and may be formed of plastic, rubber, or another at least partially compressible material. In an exemplary embodiment, the seal 350 may be seated in a groove (not shown) along the bottom face 228 of the mounting flange 226 around the second opening 214 to the chamber 210. The seal 350 may be designed to be compressed between the bottom face 228 and the panel 106 (shown in FIG. 1) upon mounting the HV header assembly 100 to the device 102 (shown in FIG. 1), sealing the interface to prevent the entry of contaminants.

Figure 4:
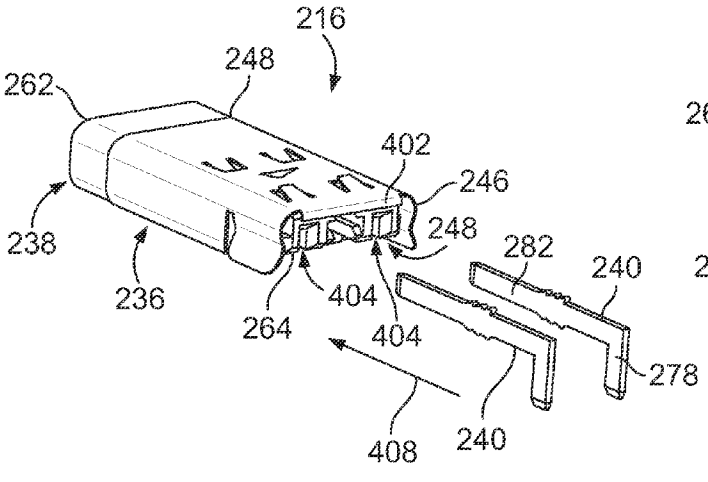
FIG. 4 illustrates a partially assembled contact subassembly for the HV header assembly.

FIG. 4 is a partially assembled view of the contact subassembly 216 with the HV contacts 240 poised for loading into the first inner housing 238. In an exemplary embodiment, to assemble the contact subassembly 216, the first inner housing 238 is loaded into the shield cavity 248 of the first shield 236. The inner housing 238 may be loaded through the front of the cavity 248. The shield 236 may include at least one lip 402 at the rear 246 that is bent inward towards the cavity 248. The lip 402 acts as a stop by engaging with the rear 264 of the inner housing 238 to prevent the housing 238 from loading beyond a predefined point. Alternatively, one or more tabs along the shield 236 may perform the same function without using a lip. The inner housing 238 may be configured to be longer than the shield 236, such that when the inner housing 238 has reached its stop point and is fully loaded in the shield 236, a portion of the inner housing 238 at the front 262 is not surrounded by the shield 236.

The HV contacts 240 may be loaded into the inner housing 238 in a loading direction 408 into a first set of contact channels 404 within the inner housing 238. In an exemplary embodiment, the HV contacts 240 are loaded, mating end 274 first, into the channels 404 from the rear 264 of the inner housing 238 to the front 262. The channels 404 are sized to receive the linear stems 282 of the HV contacts 240. The tails 278 are configured to extend from the channels 404. The tails 278 may provide a loading stop point for the HV contacts 240. Once loaded, the mating ends 274 of the HV contacts 240 are positioned within the inner cavity 266 of the inner housing 238 and poised for mating with plug contacts (not shown) of the plug assembly 104 (shown in FIG. 1).

Figure 5:
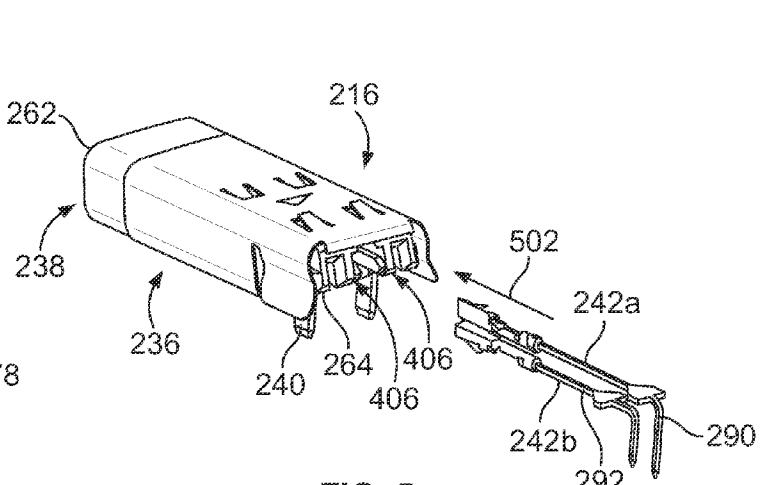
FIG. 5 illustrates the partially assembled contact subassembly.

FIG. 5 is a partially assembled view of the contact subassembly 216 with the HV contacts 240 loaded into the inner housing 238 and the HVIL contacts 242 poised for loading into the inner housing 238. In an exemplary embodiment the HVIL contacts 242 are loaded, mating end 287 first, into a second set of contact channels 406 within the inner housing 238 from the rear 264 in a loading direction 502. Once loaded, the shield 236 substantially surrounds the HV contacts 240 and HVIL contacts 242 to provide electrical shielding for the contacts 240, 242.

In an exemplary embodiment, the contact channels 406 for the HVIL contacts 242 are located between the contact channels 404 housing the HV contacts 240. For example, the contact channels 406 may be stacked vertically with the contact channels 404 arranged on opposite sides of the contact channels 406 like bookends. Due to vertical stacking of the contact channels 406, in an exemplary embodiment, the stem 292 and/or tail 290 of the upper HVIL contact 242A (i.e., the HVIL contact 242 furthest from the mounting flange 226 (shown in FIG. 3)) may be longer than the stem 292 and/or tail 290 of the lower HVIL contact 242B.

It should be noted that the order of the figures presented does not indicate a required order of assembly of the contact subassembly 216, nor do the assembly steps discussed constitute all possible steps or necessary steps to assemble the contact subassembly 216.

Figure 6:
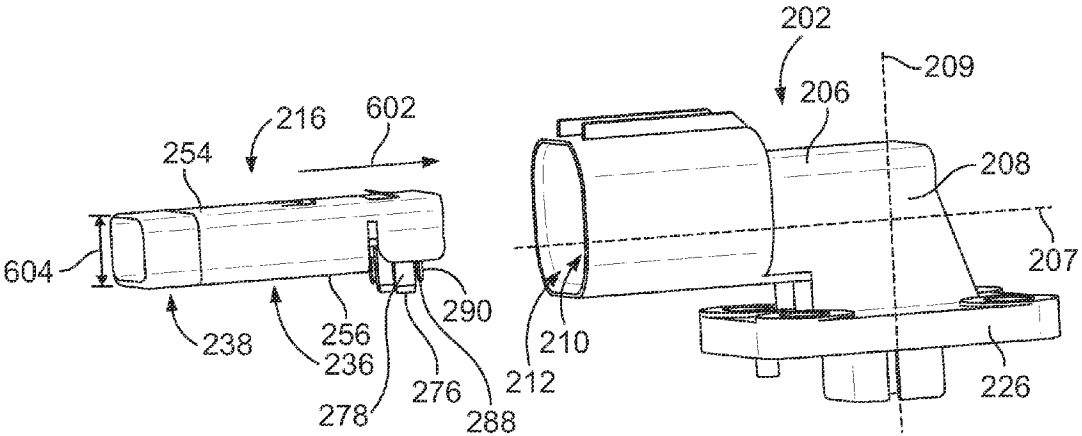
FIG. 6 illustrates the contact subassembly poised for loading into an outer housing of the HV header assembly.

FIG. 6 illustrates the contact subassembly 216 poised for loading into the outer housing 202 according to an exemplary embodiment. The contact subassembly 216 is configured to be received in the chamber 210 of the outer housing 202 through the first opening 212 along a loading direction 602. The loading direction 602 may be parallel to the first axis 207 of the outer housing 202 and/or parallel to the portion of the chamber 210 defined by the first segment 206. The subassembly 216 is oriented such that the tails 278, 290 of the HV contacts 240 and HVIL contacts 242, respectively, extend in a direction parallel to the second axis 209 of the outer housing 202 and toward the mounting flange 226. As shown in FIG. 6, the tails 278, 290 may extend beyond the plane defined by the bottom 256 of the shield 236. The vertical diameter of the mating interface 220 (e.g., from a top to a bottom along the first segment 206) is configured to be greater than a combined height 604 from the top 254 of the shield 236 to the terminating ends 276, 288 to allow the contact subassembly 216 to enter the chamber 210. In an exemplary embodiment, contact subassembly 216 is loaded into the chamber 210 prior to the terminal subassembly 218 (shown in FIG. 3). In other embodiments, the terminal subassembly may be loaded first, such as if the HV and HVIL terminals have right angle tails (like the HV contacts 240 and HVIL contacts 242).

Figure 7:
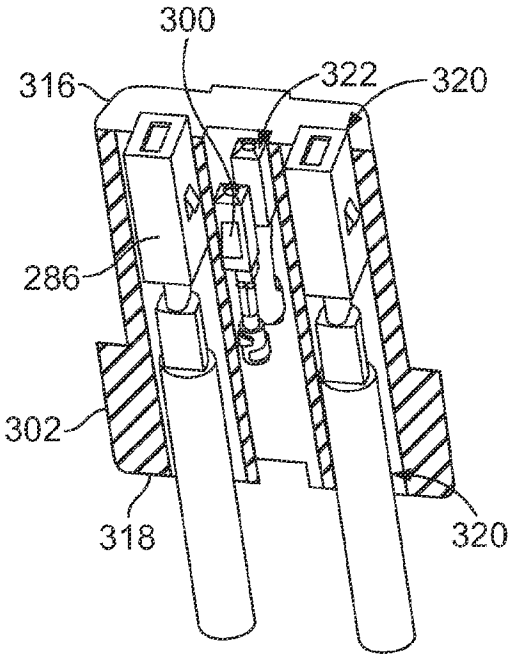
FIG. 7 is a partial sectional view of a terminal subassembly of the HV header assembly.

FIG. 7 is a partial sectional view of the terminal subassembly 218 showing the HV terminals 286 and the HVIL terminals 300 loaded in the second inner housing 302 with a portion of the second inner housing 302 being sectioned to illustrate the terminals 286, 300. During assembly, the HV terminals 286 are loaded into the first set of cavities 320, and the HVIL terminals 300 are loaded into the second set of cavities 322. The cavities 322 may be provided between the cavities 320. In an exemplary embodiment, the HV and HVIL terminals 286, 300 have sockets 334, 344, respectively along the respective contact ends 328, 340. The HV and HVIL terminals 286, 300 are loaded into the respective cavities 320, 322 from the bottom 318 of the second inner housing 302 towards the top 316, until the contact ends 328, 340 of the terminals 286, 300, respectively, are proximate to the top 316.

Figure 8:
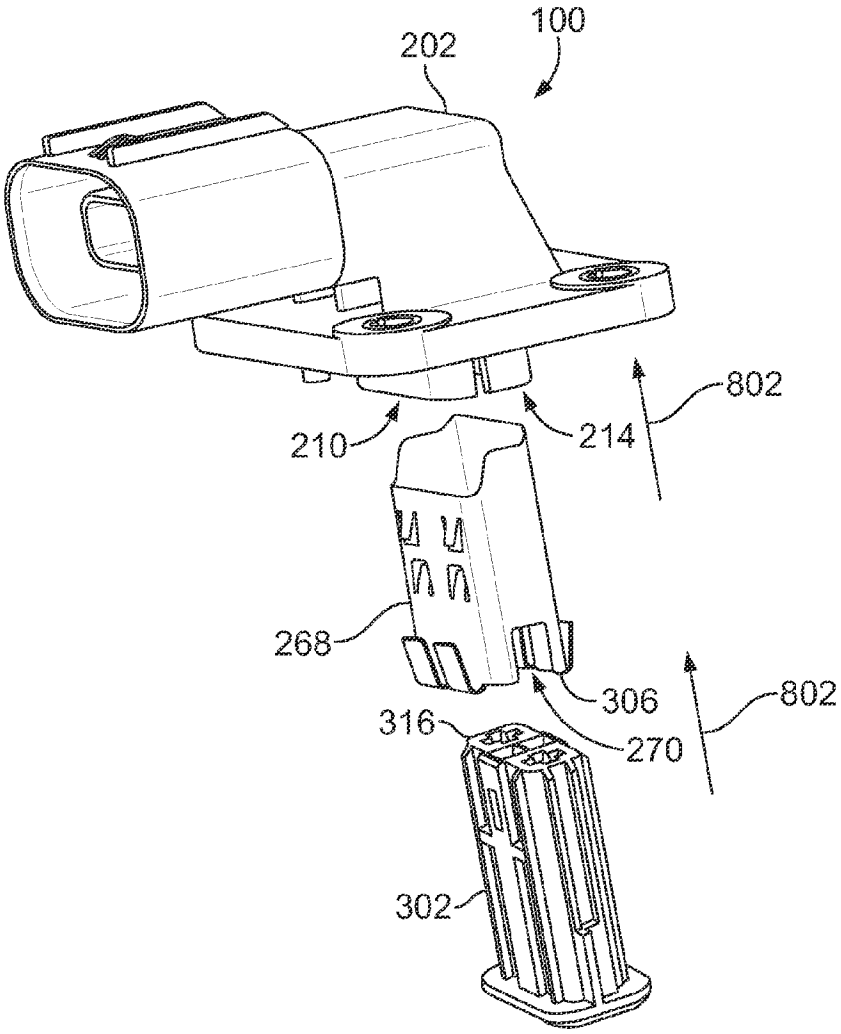
FIG. 8 is an exploded perspective view of the HV header assembly with the terminal assembly poised for loading into the outer housing of the HV header assembly.

FIG. 8 is a partially assembled perspective view of the HV header assembly 100 showing the second shield 268 and the second inner housing 302 poised for loading into the outer housing 202. In an exemplary embodiment, the second shield 268 is loaded into the chamber 210 of the outer housing 202 in a loading direction 802 through the second opening 214. Within the chamber 210, the shield 268 contacts the shield 236 (shown in FIG. 6) of the contact subassembly 216 (shown in FIG. 6). The second inner housing 302 is configured to be loaded within the chamber 210 in the loading direction 802. In an exemplary embodiment, the shield 268 may be loaded first, then the inner housing 302 loaded through the bottom end 306 of the shield 268 into the shield cavity 270. Alternatively, the shield 268 and inner housing 302 may be preassembled and loaded into the outer housing 202 as a unit. The HV and HVIL terminals 286, 300 (shown in FIG. 7) may be pre-loaded within the inner housing 302 prior to the inner housing 302 being received in the chamber 210. Alternatively, the terminals 286, 300 may be loaded into the inner housing 302 after the inner housing 302 is loaded into the outer housing 202. In an alternative embodiment, the terminal subassembly 218 (shown in FIG. 3), including the shield 268, inner housing 302, HV terminals 286, and HVIL terminals 300, is assembled externally then loaded into the chamber 210 through the second opening 214.

FIG. 9 is a partial sectional view of the HV header assembly 100 with a portion of the outer housing 202 sectioned to illustrate the contact subassembly 216 and terminal subassembly 218. FIG. 9 shows the first shield 236 of the contact subassembly 216 mated to the second shield 268 of the terminal subassembly 218. In an exemplary embodiment, the terminal subassembly 218 is loaded in the chamber 210 through the second opening 214 (shown in FIG. 8) after the contact subassembly 216 has been loaded through the first opening 212 (shown in FIG. 6). Within the chamber 210, the terminal subassembly 218 is oriented perpendicularly to the contact subassembly 216. The first shield 236 couples to the second shield 268 through an interference fit at a separable interface 902. The separable interface 902 may be along the exposed regions 258, 314 (both shown in FIG. 3) of the first and second shields 236, 268, respectively. The deflectable beams 250 of the first shield 236 are biased against the second shield 268 near the separable interface 902 to ensure contact and provide a retention force. The HV terminals 286 and HVIL terminals 300 (both shown in FIG. 3) electrically connect with the HV and HVIL contacts 240, 242 (shown in FIG. 3), respectively, housed in the contact subassembly 216. For example, when the terminal subassembly 218 mates with the contact subassembly 216, the terminating ends 276, 288 (shown in FIG. 3) of the contact tails 278, 290 (shown in FIG. 3) are received in the terminal sockets 334, 344 (shown in FIG. 3), respectively. When mated, the first shield 236 and second shield 268 provide full 360° shielding around the contacts and terminals along the entire length thereof, including through the right angle.

Figure 10:
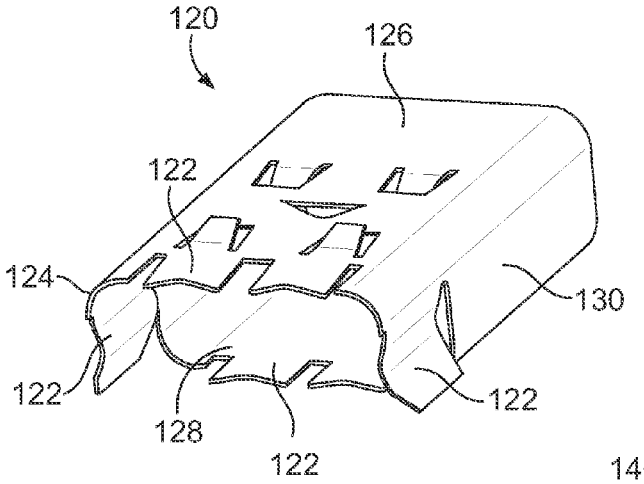
FIG. 10 is a perspective view of a first shield of the HV header assembly according to an exemplary embodiment.

FIG. 10 is a perspective view of a first shield 120 that may be used with the contact subassembly 216, such as in place of the shield 236. The first shield 120 may be formed with multiple deflectable beams 122. The deflectable beams 122 may be located along a rear 124 of the shield 120 on a top 126, bottom 128, and both sides 130. The deflectable beams 122 provide additional contact surfaces between the first shield 120 and a second shield 140 (shown in FIG. 11).

Figure 11:
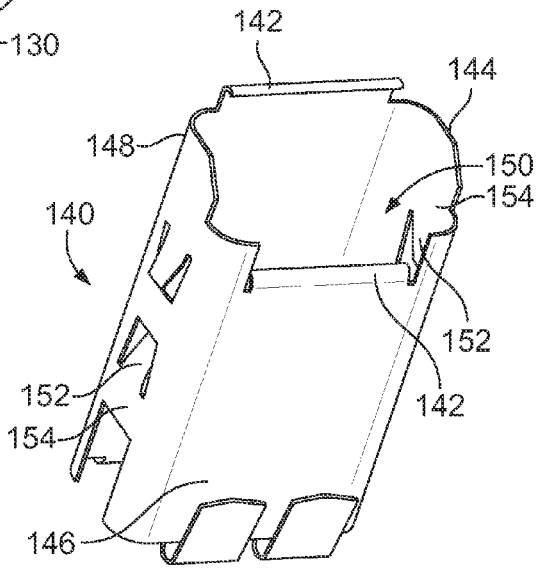
FIG. 11 is a perspective view of a second shield of the HV header assembly according to an exemplary embodiment.

FIG. 11 is a perspective view of a second shield 140 that may be used with the terminal subassembly 218, such as in place of the shield 268. The second shield 140 may have one or more ribs 142 proximate to a top 144 of the shield 140. The ribs 142 may be folded regions along a front 146 and a back 148 of the shield 140. The ribs 142 may extend towards an interior cavity. Optionally, the second shield 140 may include tabs 152 located along one or both sides 154 of the shield 140.

Figure 12:
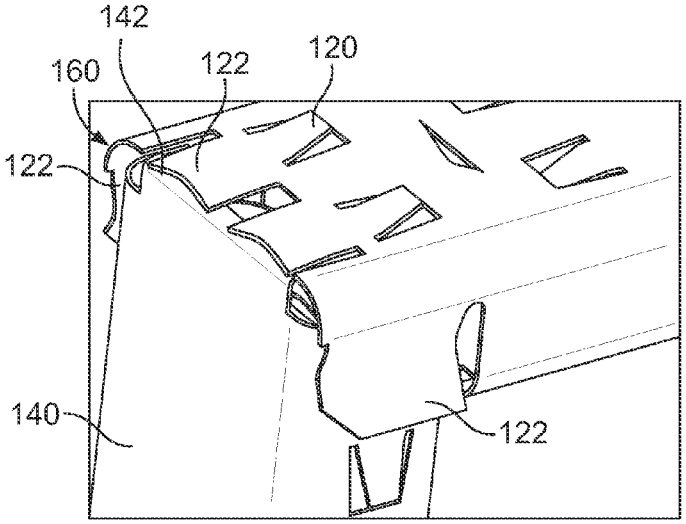
FIG. 12 is a perspective view of a portion of the first shield coupled to the second shield shown.

FIG. 12 is a perspective view illustrating the first shield 120 coupled to the second shield 140. The shields 120, 140 may be releasably coupled at a separable interface 160. When mated, the first shield 120 is oriented at a right angle to the second shield 140. The deflectable beams 122 may contact the second shield 140 and retain contact by an interference fit. In an exemplary embodiment, the deflectable beams 122 along the top 126 of the first shield 120 contact the rib 142 at the back 148 of the second shield 140. Additionally, the deflectable beams 122 along the bottom 128 contact the rib 142 at the front 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A high voltage (HV) header assembly comprising:

an outer housing having a right angle body comprising a first segment and a second segment oriented at a right angle to the first segment, the first segment having a mating interface at a distal end thereof defining a socket for mating with a plug assembly, the first segment having an outer surface including a bottom, the second segment extending downward from the bottom and having a mounting flange at a distal end thereof configured to be mounted to a device, the second segment extending from the first segment such that the mounting flange is positioned a distance below the bottom of the first segment and oriented perpendicularly to the mating interface, the body defining a right angle chamber extending through the first and second segments between the mating interface and the mounting flange, the chamber having first and second openings therethrough in the first and second segments, respectively, the first and second openings being generally perpendicular to one another, the second opening being located in the second segment below the bottom of the first segment;

HV contacts received in the chamber of the outer housing, the HV contacts being configured to electrically connect to plug contacts of the plug assembly, the HV contacts each having a stem extending at least partially along the portion of the chamber through the first segment, and the HV contacts each having a tail aligned with and facing the portion of the chamber through the second segment; and HV terminals received in the portion of the chamber through the second segment, the HV terminals being electrically connected to corresponding tails of the HV contacts at separable mating interfaces, the HV terminals being oriented generally perpendicular to corresponding stems of the HV contacts.

2. The HV header assembly of claim 1, wherein the HV contacts each comprise a mating end defined by the stem and a terminating end defined by the tail, the terminating end being oriented perpendicularly to the mating end.

3. The HV header assembly of claim 1, further comprising a contact subassembly having the HV contacts, a first shield received within the chamber through the first opening, and a first inner housing received within the chamber with the first shield surrounding at least a portion of the first inner housing, the first inner housing defining channels to house the HV contacts.

4. The HV header assembly of claim 3, wherein, when the HV contacts are received in the first inner housing within the first shield, a diameter of the mating interface of the outer housing is greater than a combined height from a top of the first shield to terminating ends of the tails of the HV contacts to allow reception in the chamber through the mating interface at the distal end of the first segment of the outer housing.

5. The HV header assembly of claim 3, wherein the first shield comprises deflectable beams, the HV header assembly further comprises a second shield received within the chamber through the second opening, the second shield electrically connected to the deflectable beams of the first shield at a separable interface.

6. The HV header assembly of claim 3, further comprising a second shield received within the chamber through the second opening, the second shield electrically connected to the first shield, the second shield oriented generally perpendicular to the first shield within the chamber.

7. The HV header assembly of claim 6, further comprising a second inner housing received within the chamber, the second shield surrounding at least a portion of the second inner housing, the second inner housing defining cavities to house the HV terminals, the HV terminals being electrically connected with the HV contacts.

8. The HV header assembly of claim 1, further comprising high voltage interlock (HVIL) contacts received in the chamber of the outer housing, the HVIL contacts being configured to electrically connect to HVIL plug contacts of the plug assembly, the HVIL contacts each having an stem extending at least partially along the first segment, and the HVIL contacts each having a tail extending at least partially along the second segment, the stem oriented perpendicularly to the tail.

9. The HV header assembly of claim 1, wherein the outer housing comprises a single piece construction having a closed rear at the intersection of the first and second segments, the first opening being open through a front opposite the rear located at the mating interface at the distal end of the first segment such that the HV contacts are loaded into the chamber through the front of the outer housing, the second opening being open through a bottom of the second segment such that the HV terminals are loaded into the chamber through the bottom of the outer housing, the HV contacts and the HV terminals being completely surrounded by the outer housing.

10. The HV header assembly of claim 1, wherein the mounting flange is configured to mount to a panel of the device, a plane defined by the panel being generally perpendicular to the mating interface.

11. A high voltage (HV) header assembly comprising:

an outer housing having a right angle body comprising a first segment and a second segment oriented at a right angle to the first segment, the first segment extending from a front of the outer housing to a rear of the outer housing, the second segment provided at the rear of the outer housing and extending below the first segment to a bottom of the outer housing, the body defining a right angle chamber extending through the first and second segments, the chamber having first and second openings therethrough in the first and second segments, respectively, the outer housing being closed at the rear and at a top thereof with the first opening provided at the front and with the second opening provided at the bottom;

a contact subassembly received in the chamber through the first opening at the front, the contact subassembly comprising a first shield, a first inner housing at least partially surrounded by the first shield, HV contacts received within a first set of channels within the first inner housing, and high voltage interlock (HVIL) contacts received within a second set of channels within the first inner housing, the contact subassembly being configured to be mated with a plug assembly at a mating interface; and a terminal subassembly received in the chamber through the second opening at the bottom, the terminal subassembly comprising a second shield, a second inner housing at least partially surrounded by the second shield, HV terminals received within a first set of cavities within the second inner housing, and HVIL terminals received within a second set of cavities within the second inner housing;

wherein the contact subassembly and terminal subassembly are oriented at right angles with respect to one another, the contact subassembly is coupled to the terminal subassembly at a separable interface within the chamber.

12. The HV header assembly of claim 11, wherein the first segment has a mating interface at a distal end thereof defining a socket for mating with a plug assembly.

13. The HV header assembly of claim 11, wherein the second segment has a mounting flange at a distal end thereof configured to be mounted to a panel of a device.

14. The HV header assembly of claim 11, wherein the HV contacts and the HVIL contacts each comprise a mating end and a terminating end, the terminating end having a tail extending perpendicularly to a longitudinal axis of the contact subassembly.

15. The HV header assembly of claim 14, wherein the HV terminals and HVIL terminals each comprise sockets at contact ends thereof, the tails are received within corresponding sockets to electrically connect the HV contacts and HVIL contacts to the HV terminals and HVIL terminals, respectively.

16. The HV header assembly of claim 11, wherein the HV contacts are coupled to the HV terminals at the separable interface and the HVIL contacts are coupled to the HVIL terminals at the separable interface.

17. The HV header assembly of claim 11, wherein the first shield is electrically coupled to the second shield at the separable interface.

18. The HV header assembly of claim 11, wherein the first shield has deflectable beams configured to produce an interference fit with the second shield at the separable interface.

19. The HV header assembly of claim 11, wherein the first shield and the second shield are configured to provide 360° shielding of the HV contacts, HVIL contacts, HV terminals, and HVIL terminals at the separable interface.

20. The HV header assembly of claim 11, wherein the HV contacts are coupled to the HV terminals at the separable interface and the HVIL contacts are coupled to the HVIL terminals at the separable interface, the first shield and the second shield configured to provide 360° shielding of the HV contacts, HVIL contacts, HV terminals, and HVIL terminals at the separable interface.

* * * * *